US008909080B2

(12) United States Patent
Mochizuki

(10) Patent No.: US 8,909,080 B2
(45) Date of Patent: Dec. 9, 2014

(54) IMAGE FORMING APPARATUS HAVING TRANSFER VOLTAGE SETTING PORTION

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 13/453,878

(22) Filed: Apr. 23, 2012

(65) Prior Publication Data

US 2012/0275808 A1 Nov. 1, 2012

(30) Foreign Application Priority Data

Apr. 28, 2011 (JP) ..... 2011-101427

(51) Int. Cl.
*G03G 15/16* (2006.01)
*G03G 15/00* (2006.01)

(52) U.S. Cl.
USPC ..... 399/66; 399/44; 399/45

(58) Field of Classification Search
CPC ..... G03G 15/0131; G03G 15/1605; G03G 15/1645; G03G 15/1675; G03G 15/0189; G03G 21/20; G03G 21/203; G03G 2215/0119; G03G 15/5029; G03G 2215/00738; G03G 2215/00742
USPC ..... 399/44, 66, 299, 302, 303, 45
See application file for complete search history.

(56) References Cited

U.S. PATENT DOCUMENTS

| | | | | |
|---|---|---|---|---|
| 4,401,383 | A * | 8/1983 | Suzuki et al. | 399/145 |
| 6,253,041 | B1 * | 6/2001 | Tomizawa et al. | 399/66 |
| 8,218,986 | B2 * | 7/2012 | Makino | 399/44 |
| 8,275,296 | B2 * | 9/2012 | Fujikura | 399/270 |
| 2003/0215269 | A1 * | 11/2003 | Kayahara et al. | 399/297 |

FOREIGN PATENT DOCUMENTS

| | | | |
|---|---|---|---|
| JP | 11258923 | A * | 9/1999 |
| JP | 2001-166611 | A | 6/2001 |
| JP | 2003-270974 | A | 9/2003 |
| JP | 2004-29054 | A | 1/2004 |
| JP | 2004145151 | A * | 5/2004 |
| JP | 2010-128235 | A | 6/2010 |
| JP | 2010-243553 | A | 10/2010 |

* cited by examiner

*Primary Examiner* — Robert Beatty
(74) *Attorney, Agent, or Firm* — Canon USA Inc. IP Division

(57) ABSTRACT

An image forming apparatus includes a control unit having a first function and a second function. The first function controls a downstream transfer current to be less than an upstream transfer current. The second function controls the downstream transfer current to be greater than the upstream transfer current.

10 Claims, 5 Drawing Sheets

IMAGE FORMING APPARATUS HAVING TRANSFER VOLTAGE SETTING PORTION

BACKGROUND OF THE INVENTION

1. Field of the Invention

The present invention relates to an image forming apparatus such as a copying machine, a printer, or the like using an electrophotography method or an electrostatic recording method.

2. Description of the Related Art

To make it possible for an image forming apparatus to handle a wide variety of types of recording materials, it is known to provide a transfer portion therein that transfers a toner image formed on a photosensitive drum or the like functioning as an image bearing member to an intermediate transfer member and further transfers the toner image from the intermediate transfer member to a recording material.

Japanese Patent Laid-Open No. 2004-29054 discloses a technique in which a transfer portion for transferring a toner image to a recording material is configured such that it has a large width in a direction in which the recording material is conveyed to thereby reduce an applied voltage and achieve an improvement in image quality. More specifically, the transfer portion includes two inner transfer rollers located in contact with an inner surface of an intermediate transfer member and two outer transfer rollers that are located in contact with an outer surface of the intermediate transfer member and that are urged against the respective two inner transfer rollers via the intermediate transfer member. In this technique disclosed in Japanese Patent Laid-Open No. 2004-29054, a transfer electric field is set such that it has a maximum value at the location of the downstream inner transfer roller.

Japanese Patent Laid-Open No. 2010-243553 discloses a technique in which a roller and a plate are used to transfer a toner image from a transfer belt to a recording material. In this technique disclosed in Japanese Patent Laid-Open No. 2010-243553, to enhance a transfer efficiency, a current flowing through the plate disposed at a downstream location is set to be lower than a current flowing through the roller disposed at an upstream location.

However, if the moisture content of the recording material is low, then this can produce a problem that the recording material becomes electrostatically stuck to the intermediate transfer member and the recording material remains on the intermediate transfer member without being separated from the intermediate transfer member after the transfer is complete.

SUMMARY OF THE INVENTION

One aspect of the present invention provides an image forming apparatus that includes two transfer members for transferring a toner image to a recording material, thereby achieving a reduction in an applied voltage and an improvement in image quality, and achieving high recording material separation performance after the transfer process is complete even when the moisture content of the recording material is low.

According to an aspect of the present invention, an image forming apparatus includes an image bearing member configured to bear a toner image, an intermediate transfer member configured to be movable and to bear a toner image transferred from the image bearing member, a first transfer member configured to transfer the toner image from the intermediate transfer member to a recording material, a second transfer member, located in a downstream direction from the first transfer member, in which the intermediate transfer member is conveyed and is configured to transfer the toner image from the intermediate transfer member to the recording material, a voltage application unit configured to apply voltages to the first transfer member and the second transfer member to transfer the toner image from the intermediate transfer member to the recording material, an acquisition unit configured to acquire information associated with a moisture content, a control unit configured to individually control the voltage applied to the first transfer member and the voltage applied to the second transfer member, wherein the control unit includes a first function of controlling the voltage application unit such that a transfer current flowing through the second transfer member is less than a transfer current flowing through the first transfer member, and a second function of controlling the voltage application unit such that the transfer current flowing through the second transfer member is greater than the transfer current flowing through the first transfer member, and a process execution unit configured to execute an image forming process in a first image forming mode or a second image forming mode such that if the information acquired by the acquisition unit indicates a first moisture content for a recording material being conveyed, the process execution unit executes the image forming process to form an image in the first image forming mode using the first function, wherein if the information acquired by the acquisition unit indicates a second moisture content for the recording material less than the first moisture content, then the process execution unit executes the image forming process to form an image in the second image forming mode using the second function.

Further features of the present invention will become apparent from the following description of exemplary embodiments with reference to the attached drawings.

DESCRIPTION OF THE EMBODIMENTS

First Embodiment

Overall Configuration and Operation of Image Forming Apparatus

Figure 1:
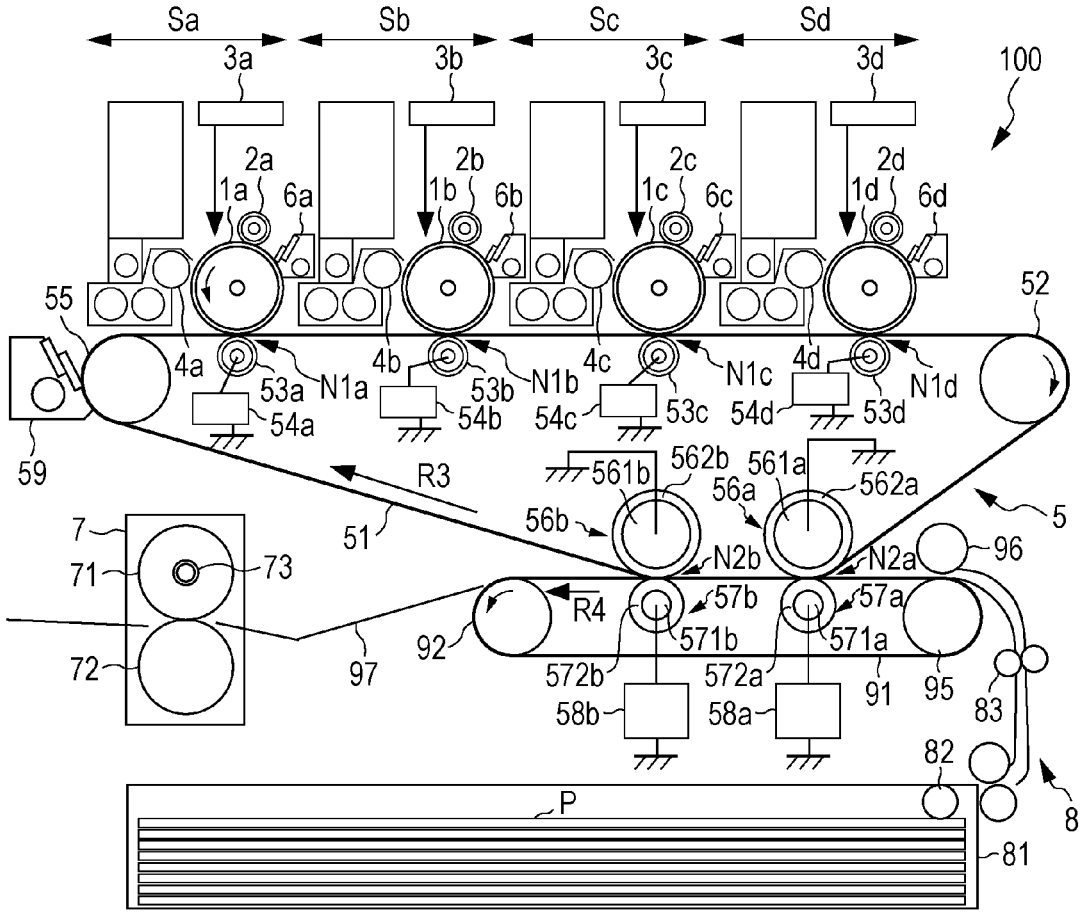
FIG. 1 is a cross-sectional view schematically illustrating a structure of an image forming apparatus according to an embodiment of the present invention.

First, an overall configuration and an operation of an image forming apparatus according to first exemplary embodiment of the present invention are described below. FIG. 1 schematically illustrates a cross-sectional structure of the image forming apparatus 100 according to the present embodiment.

Sa, Sb, Sc, and Sd denote processing units, where each serves as an image forming unit for forming a toner image. The image forming units Sa, Sb, Sc, and Sd are respectively assigned to form toner images in yellow, magenta, cyan, and black. The image forming units Sa, Sb, Sc, and Sd are configured in the same manner, with the only exception between them being that the toner used for each is different in color. For description purposes, only the image forming unit Sa will be discussed below.

The image forming unit Sa includes a photosensitive drum la serving as an image bearing member, a charging roller 2*a* serving as a charging unit for charging the surface of the photosensitive drum la, and a laser scanner 3*a* serving as an exposure unit for exposing the charged surface of the photosensitive drum. The image forming unit Sa further includes a developing unit 4*a* serving as a developing unit for developing a toner image, and a primary transfer roller 53*a* serving as a primary transfer portion for transferring the toner image from the photosensitive drum 1*a* to an intermediate transfer belt 41.

The image forming unit Sa operates as follows. The photosensitive drum 1*a* is driven to rotate, and the surface of the photosensitive drum 1*a* is charged by the charging roller 2*a* as the photosensitive drum 1*a* rotates. The surface of the charged photosensitive drum 1*a* is exposed by the laser scanner 3*a* to form an electrostatic latent image on the photosensitive drum 1*a*. More specifically, in this process, the output of the laser scanner 3 is turned on/off according to image information to form the electrostatic latent image according to the image information.

The developing unit 4*a* includes yellow toner. The developing unit 4*a* is applied with a particular voltage such that the electrostatic latent image is developed when the electrostatic latent image passes by the developing unit 4*a* and a toner image is formed on the surface of the photosensitive drum 1*a*. As for the developing method, a reversal development method may be employed. In this method, the developing is performed by depositing toner on exposed areas of the electrostatic latent image. The primary transfer roller 53*a* is disposed such that the primary transfer roller 53*a* is urged against the photosensitive drum 1*a* via the intermediate transfer belt 51 thereby forming a primary transfer portion N1*a* for transferring the toner image to the intermediate transfer belt 51. The toner image on the photosensitive drum 1*a* is transferred to the intermediate transfer belt 51 by a primary transfer voltage applied from a primary transfer power supply 54*a* to the primary transfer roller 53*a*. Residual toner on the photosensitive drum 1*a* is removed by a drum cleaner 6*a*. An intermediate transfer unit 5 is a unit configured to include the intermediate transfer unit 51.

The primary transfer roller 53*a* may be, for example, an elastic roller including a core metal 531 with an outer diameter of 8 mm and a conductive urethane sponge layer 532 with a thickness of 4 mm disposed around the core metal 531. The electric resistance of the primary transfer roller 53*a* may be equal to, for example, about $10^6\Omega$ (23° C./50% RH). The electric resistance of the primary transfer roller 53*a* may be determined from a current that is measured when a voltage of 50 V is applied to the core metal 531 while the primary transfer roller 53*a* is urged with a load 500 gram-weight so as to be in contact with a grounded metal roller and is rotated at a circumferential velocity of 50 mm/sec. In a case where a full-color image is formed, toner images of respective colors are sequentially transferred in respective corresponding primary transfer portion (N1*a*, N1*b*, N1*c*, and N1*d*) to the intermediate transfer belt 51 such that the toner images are superimposed.

The intermediate transfer belt 51 functions as an intermediate transfer member that bears and conveys the toner image transferred from the photosensitive drums 1*a*, 1*b*, 1*c*, and 1*d*. The intermediate transfer belt 51 is a belt that is disposed such that the outer surface thereof is in contact with the surface of each of the photosensitive drums 1*a*, 1*b*, 1*c*, and 1*d* and that is stretched by a plurality of supporting members 52, 55, 56*a*, and 56*b* such that the intermediate transfer belt 51 is movable. The intermediate transfer belt 51 may be formed of, for example, a polyimide (PI) resin having a thickness of 80 μm and a surface resistivity of $10^{12}$ Ω/square (measured using a probe according to the JIS-K6911 standards with an applied voltage of 100 V for an applied period of 60 seconds at a temperature/humidity of 23° C./50% RH). The intermediate transfer belt 51 is not limited to that described above, but the intermediate transfer belt 51 may be formed of other dielectric resins such as polycarbonate (PC), polyethylene terephthalate (PET), polyvinylidene fluoride (PVDF), or the like.

The supporting member 52 functions as a driving roller that drives the intermediate transfer belt 51 to move. The supporting members 56*a* and 56*b* respectively function as secondary inner transfer rollers 56*a* and 56*b* for transferring a toner image to a recording material as will be described in further detail later. In response to receiving the driving force from the intermediate transfer belt driving roller 52 servings a belt driving unit, the intermediate transfer belt 51 moves in a direction denoted by an arrow R3 shown in FIG. 1. As the intermediate transfer belt 51 moves, the toner image on the intermediate transfer belt 51 is conveyed to a secondary transfer portion where the toner image is transferred via a transfer belt 91 to the recording material.

The transfer belt 91 for supporting the recording material thereon and conveying it is a belt that is stretched by a plurality of stretching members 92 and 95 such that the transfer belt 91 is movable in a direction denoted by R4 in FIG. 1. The stretching member 92 functions as a driving roller that drives the transfer belt 91 to move.

The transfer belt 91 may be formed of, for example, carbon-dispersed polyimide (PI) resin having a thickness of 80 μm and a surface resistivity of $10^{14}$ Ω/square (measured using a probe according to the JIS-K6911 standards with an applied voltage of 1000 V for an applied period of 60 seconds at a temperature/humidity of 23° C./50% RH). The transfer belt 91 is not limited to that described above, but the transfer belt 91 may be formed of other dielectric resins such as polycarbonate (PC), polyethylene terephthalate (PET), polyvinylidene fluoride (PVDF), or the like.

A stack of recording materials is placed in a cassette 81 serving as a recording material case. A recording material is picked up by a pickup roller 82 from the cassette 81 serving as the recording material case and is conveyed by a conveying roller 83 to the transfer belt 91 through a conveying pass 8. The conveying of the recording material is performed in synchronization with conveying of the toner image to the secondary transfer portion. The recording material is stuck to the surface of the transfer belt 91 by a voltage applied to a sticking unit 96 from a bias application unit (not shown). By sticking the recording material to the transfer belt 91 before the recording material being conveyed arrives at the secondary transfer portion, it becomes possible to achieve stability in conveying the recording material through the secondary transfer portion.

In the secondary transfer portion, the toner image is transferred from the intermediate transfer belt 51 to the recording material supported and conveyed by the transfer belt 91. After the toner image is transferred to the recording material in the secondary transfer portion, the recording material P is separated from the transfer belt 91 when it comes close to a driving roller 92 that drives the transfer belt 91. Thereafter, the recording material P is conveyed along a conveying guide 97 to a fixing unit 7 serving as a fixing unit that fixes the toner image to the recording material. Residual toner remaining on the intermediate transfer belt 51 without being transferred by the secondary transfer portion to the recording material is removed by an intermediate transfer belt cleaner 59 and recovered.

The fixing unit 7 includes a fixing roller 71 rotatably disposed and a pressure roller 72 configured to rotate while being pressed against the fixing roller 71. A halogen lamp or the like serving as a heater 73 is disposed in the inside of the fixing roller 71. The temperature of the surface of the fixing roller 71 is controlled by controlling a voltage or the like supplied to the heater 73. If the conveyed recording material P arrives at the fixing unit 7, the recording material P is passed between the fixing roller 71 and the pressure roller 72 rotating at constant rotation speeds. When the recording material P is passed between the fixing roller 71 and the pressure roller 72, the recording material P is heated at a constant temperature while being applied with a constant pressure from both front and back sides thereof such that the unfixed toner image on the surface of the recording material P is fused and fixed on the recording material P. Thus, the forming of the image on the recording material P is complete.

In the image forming apparatus according to the present embodiment, to achieve higher productivity than is achieved by common image forming apparatuses, the processing speed (equal to the circumferential velocity of the photosensitive drum 1 or the intermediate transfer belt 51 and equal to the conveying speed of the recording material P) is set to 700 mm/sec.

Structure for Secondary Transfer

In the present embodiment, a secondary inner transfer roller 56*a* and a secondary inner transfer roller 56*b* stretch the intermediate transfer belt 51. The secondary inner transfer roller 56*a* and the secondary inner transfer roller 56*b* are both disposed in contact with the inner surface of the intermediate transfer belt 51. The secondary inner transfer roller 56*b* is located away from the secondary inner transfer roller 56*a* in the downstream direction in which the intermediate transfer belt 51 moves. A secondary outer transfer roller 57*a* and a secondary outer transfer roller 57*b* also stretch the transfer belt 91. The secondary outer transfer roller 57*a* and the secondary outer transfer roller 57*b* are both disposed in contact with the inner surface of the transfer belt 91. The secondary outer transfer roller 57*b* is located away from the secondary outer transfer roller 57*a* in the downstream direction in which the transfer belt 91 moves. The secondary inner transfer rollers 56*a* and 56*b* and the secondary outer transfer rollers 57*a* and 57*b* function as secondary transfer members forming a secondary transfer portion that transfers the toner image from the intermediate transfer belt 51 to the recording material.

The upstream secondary outer transfer roller 57*a* (first outer transfer roller) is located such that it opposes the upstream secondary inner transfer roller 56*a* (first inner transfer roller) via the transfer belt 91 and the intermediate transfer belt 51. The upstream secondary outer transfer roller 57*a* forms a pressing unit (first pressing unit N2*a*) that is urged against the upstream secondary inner transfer roller 56*a* via the transfer belt 91 and the intermediate transfer belt 51. The downstream secondary outer transfer roller 57*b* (second outer transfer roller) is located such that it opposes the downstream secondary inner transfer roller 56*b* (second inner transfer roller) via the transfer belt 91 and the intermediate transfer belt 51. The downstream secondary outer transfer roller 57*b* forms a pressing unit (second pressing unit N2*b*) that is urged against the downstream secondary inner transfer roller 56*b* via the transfer belt 91 and the intermediate transfer belt 51.

When a secondary transfer voltage is applied to the secondary outer transfer rollers 57*a* and 57*b*, transfer electric fields are formed in the corresponding pressing units N2*a* and N2*b* and the toner image is transferred to the recording material in the first pressing unit N2*a* and the second pressing unit N2*b*. Thus, by forming a plurality of pressing units, it becomes possible to increase the width of the secondary transfer portion for transferring the toner image to the recording material P in the direction in which the recording material P is conveyed.

Each of the secondary inner transfer rollers 56*a* and 56*b* may be, for example, an elastic roller including a core metal 561*a* or 561*b* with an outer diameter of 18 mm and a conductive and solid silicone rubber layer 562*a* or 562*b* with a thickness of 2 mm disposed around the core metal 561*a* or 561*b*. The electric resistance of each of the secondary inner transfer roller 56*a* and 56*b* may be equal to about $10^4$ Ω as measured in the same manner as the primary transfer roller 53*a*. Note that the electric resistance of the secondary inner transfer rollers 56*a* and 56*b* is not limited to that described above.

Each of the secondary outer transfer rollers 57*a* and 57*b* may be, for example, an elastic roller including a core metal 571*a* or 571*b* with an outer diameter of 8 mm and a conductive EPDM rubber sponge layer 572*a* or 572*b* with a thickness of 4 mm disposed around the core metal 571*a* or 571*b*. The electric resistance of each of the secondary outer transfer rollers 572*a* and 572*b* may be equal to about $3\times10^7$ Ω as measured with an applied voltage of 2000 V in the same manner as the primary transfer roller 53*a*. The electric resistance of each of the secondary outer transfer rollers 57*a* and 57*b* is set to be greater than or equal to $10^7$ Ω. When the electric resistance of each of the secondary outer transfer rollers 57*a* and 57*b*, which are respectively connected to secondary transfer voltage power supplies 58*a* and 58*b*, is greater than or equal to $10^7$ Ω, the electric resistance of each of the secondary outer transfer rollers 57*a* and 57*b* is much higher than the electric resistance of the recording material. This makes it possible to prevent a large current from flowing through a part through which the recording material is not passed in a width direction in the secondary transfer process.

In the present embodiment, secondary transfer voltage power supplies 58*a* and 58*b* are provided as secondary transfer voltage application units adapted to supply secondary transfer voltages by which to transfer the toner image to the recording material. By applying the secondary transfer voltages to the secondary outer transfer rollers 57*a* and 57*b* from the secondary transfer voltage power supplies 58*a* and 58*b*, the toner image on the intermediate transfer belt 51 is electrostatically transferred to the recording material.

Figure 3:
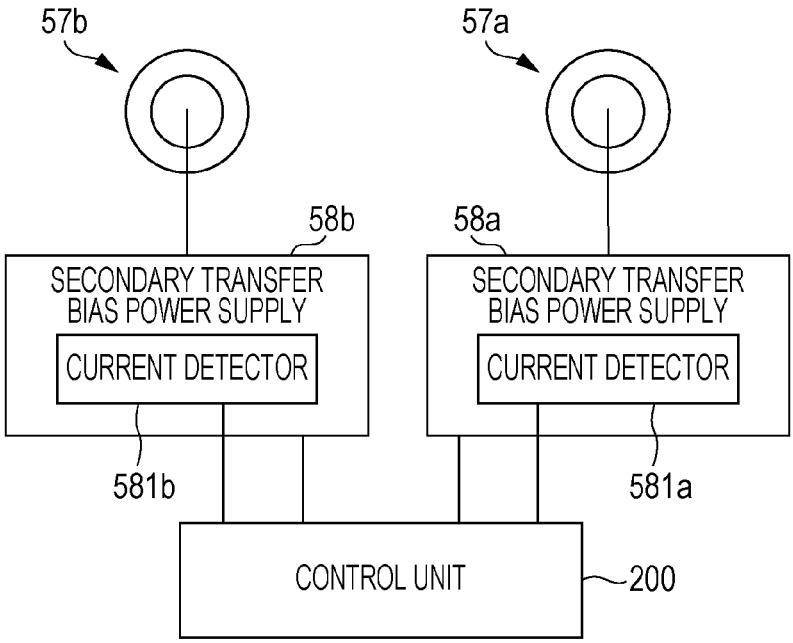
FIG. 3 is a block diagram illustrating a transfer control mechanism in an image forming apparatus according to an embodiment of the present invention.

In the present embodiment, as shown in FIG. 1 and FIG. 3, the upstream secondary outer transfer roller 57*a* is connected to the secondary transfer voltage power supply 58*a*, while the upstream secondary inner transfer roller 56*a* is grounded. The downstream secondary outer transfer roller 57*b* is connected to the secondary transfer voltage power supply 58*b*, while the downstream secondary inner transfer roller 56*b* is grounded. A voltage applied from the secondary transfer voltage power supply 58*a* to the upstream secondary outer transfer roller 57*a* causes an electric field to be formed between the upstream secondary outer transfer roller 57*a* and the secondary inner transfer roller 57*a*. A voltage applied from the secondary transfer voltage power supply 58*b* to the downstream secondary outer transfer roller 57*b* causes an electric field to be formed between the downstream secondary outer transfer roller 57*b* and the secondary inner transfer roller 56*b*.

Thus, the secondary outer transfer rollers 57*a* and 57*b* serve as transfer members for transferring a toner image to a recording material, while the secondary inner transfer rollers 56*a* and 56*b* serve as opposing members opposing the transfer members.

In an operation in which the toner image is transferred to the recording material, voltages with a polarity opposite to a normal polarity (negative polarity) of toner are applied as secondary transfer voltages to the respective secondary outer transfer rollers 57*a* and 57*b* by which to transfer the toner image to the recording material. The transfer electric fields formed as a result of the application of the secondary transfer voltages cause the toner with the normal polarity to move from the intermediate transfer belt 51 toward the recording material P. One of the transfer electric fields is formed in the first pressing unit N2*a* located between the upstream secondary inner transfer roller 56*a* and the secondary outer transfer roller 57*a*, while the other one of the transfer electric fields is formed in the second pressing unit N2*b* located between the downstream secondary inner transfer roller 56*b* and the secondary outer transfer roller 57*b*. As a result, two current paths through which transfer currents flow to transfer the toner image to the recording material, i.e., one current path is formed so as to pass through the first pressing unit N2*a* and the other current path is formed so as to pass through the second pressing unit N2*b*.

Depending on the configuration of the image forming apparatus, a large current is needed in transferring of a toner image to a recording material. However, in known configurations, there is provided only one path through which the transfer current flows in the transferring of the toner image to the recording material. In such configurations, if a large current is required to transfer the toner image to the recording material, it is necessary to increase a voltage applied to the secondary transfer portion. However, the increase in the applied voltage may cause an electric discharge to occur in a region upstream of the secondary transfer portion, which may disturb the production of the image. Thus, there is a need for a configuration that makes it possible to transfer a toner image without needing a significant increase in the applied voltage even in a case in which a large current is required. In the present embodiment, in view of the above, there are provided two current paths such that a transfer current necessary in transferring a toner image is divided into two flows and passed through the two current paths. This configuration makes it possible to suppress an increase in voltage applied to the secondary transfer portion than can be in the configuration having only one path via which the transfer current can flow in the transferring of the toner image.

In the present embodiment, the secondary transfer voltage power supplies 58*a* and 58*b* are respectively connected to the secondary outer transfer rollers 57*a* and 57*b* as described above. Alternatively, the secondary transfer voltage power supplies 58*a* and 58*b* may be respectively connected to the secondary inner transfer rollers 56*a* and 56*b*. In this case, the polarity of the secondary transfer bias applied to the secondary inner transfer rollers 56*a* and 56*b* is set such that the secondary transfer bias has the same polarity as that of the toner.

If the secondary transfer voltage power supply 58*a* is connected to the upstream secondary outer transfer roller 57*a* and the secondary transfer voltage power supply 58*b* is connected to the downstream secondary inner transfer roller 56*b*, then a following problem may occur. That is, in this case, when the secondary transfer process is performed, the polarity of the bias applied to the upstream secondary outer transfer roller 57*a* is opposite to that of the toner, while the polarity of the bias applied to the downstream secondary inner transfer roller 56*b* is the same as that of the toner. This may cause too large a current to flow from the upstream secondary outer transfer roller 57*a* to the secondary inner transfer roller 56*b* via the intermediate transfer belt 51, which may make it difficult to properly divide the transfer current into two flows through the first pressing unit N2*a* and the second pressing unit N2*b*. Therefore, to properly divide the transfer current, the secondary transfer voltage power supplies are both connected to the secondary outer transfer rollers or both to the secondary inner transfer rollers.

In the present embodiment, the transfer belt 91 is used to convey the recording material P in the secondary transfer portion. This makes it possible to stably hold the recording material P on the transfer belt 91 and stably convey the recording material P by the transfer belt 91 without producing a deviation of the recording material P from the intermediate transfer belt 51 in the secondary transfer portion. Note that the configuration is not limited to that described above. For example, when a reduction in cost is important, the transfer belt 91 may be removed.

Furthermore, in the present embodiment, there are provided two secondary outer transfer rollers 57*a* and 57*b*, and two secondary inner transfer rollers 56*a* and 56*b* thereby forming two pressing units such that the secondary inner transfer rollers 56*a* and 56*b* are grounded and bias power supplies 58*a* and 58*b* are respectively connected to the secondary outer transfer rollers 57*a* and 57*b*. Note that the configuration is not limited to that described above, but the two pressing units may be configured in other manners as long as the voltages applied to the respective pressing units can be individually controlled.

In an alternative embodiment, two secondary outer transfer rollers 57*a* and 57*b* and two secondary inner transfer rollers 56*a* and 56*b* may be provided such that the secondary outer transfer rollers 57*a* and 57*b* are grounded and the secondary transfer voltage power supplies 58*a* and 58*b* are respectively connected to the secondary inner transfer rollers 56*a* and 56*b*. In another alternative embodiment, two secondary outer transfer rollers 57*a* and 57*b* and one secondary inner transfer roller 56 may be provided such that the secondary inner transfer roller 56 is grounded and the secondary transfer voltage power supplies 58*a* and 58*b* are respectively connected to the secondary outer transfer rollers 57*a* and 57*b*. In still another embodiment, one secondary outer transfer roller 57 and two secondary inner transfer rollers 56*a* and 56*b* may be provided such that the secondary inner transfer roller 57 is grounded and the secondary transfer voltage power supplies 58*a* and 58*b* are respectively connected to the secondary inner transfer rollers 56*a* and 56*b*.

In the present embodiment, as described above, two secondary outer transfer rollers 57*a* and 57*b* are provided to form two pressing units. However, the number of secondary outer transfer rollers is not limited to two, but three or more secondary outer transfer rollers may be provided to form three or more pressing units.

Voltage Control for Secondary Transfer

In the present embodiment, the voltages applied from the secondary transfer voltage power supplies 58*a* and 58*b* are controlled by a control unit 200. The control unit 200 controls the voltages based on the basis weight information of the recording material specified by a user, the current flowing through the upstream secondary outer transfer roller 57*a* measured by a current measurement unit 581*a*, and the current flowing through the downstream secondary outer transfer roller 57*b* measured by a current measurement unit 581*b*. The control unit 200 includes a CPU, a ROM, and a RAM. Note that the basis weight refers to a weight per unit area (g/m$^2$), and the basis weight is widely used to indicate the thickness of a recording material.

In the present embodiment, to optimize the secondary transfer voltage used in transferring of a toner image to a recording material, an adjustment process called ATVC (Auto Transfer Voltage Control) is performed to adjust the voltages during a period in which no recording material is fed before the secondary transfer process for transferring the toner image to the recording material.

In the ATVC adjustment process, a plurality of adjustment voltages controlled so as to be constant in voltage value are applied by the secondary transfer voltage power supplies, and currents that flow in response to the respective adjustment voltages are measured. The correlation between the voltage and the current is determined from the measurement result, and a voltage V1 required to provide a target current It necessary in the secondary transfer process is determined based on the correlation between the applied adjustment voltages and the measured currents. The sum of the voltage V1 and a voltage V2 applied to the recording material is then calculated. A voltage equal to the determined sum, V1+V2, is set as a target voltage Vt of the secondary transfer voltage. During the secondary transfer process following the adjustment process, the secondary transfer voltage is controlled to be equal to the constant target voltage Vt. Thus, the secondary transfer voltage is set to the optimum value to provide the necessary transfer current. The applied secondary transfer voltage is controlled to be equal to the constant value during the secondary transfer operation, and thus a stable secondary transfer operation is achieved regardless of the width of the recording material.

In the present embodiment, the secondary transfer voltage power supplies 58*a* and 58*b* supply the secondary transfer voltages to the respective secondary outer transfer rollers 57*a* and 57*b*. Therefore, the secondary transfer voltages are optimized separately for the secondary outer transfer rollers 57*a* and 57*b* at upperstream and downstream locations.

The adjustment processes for the secondary outer transfer rollers 57*a* and 57*b* at upperstream and downstream locations are performed concurrently. More specifically, the secondary transfer voltage power supply 58*a* applies two adjustment voltages V1 and V2 to the secondary outer transfer roller 57*a* at the upperstream location, while the secondary transfer voltage power supply 58*b* applies two adjustment voltages V1 and V2 to the secondary outer transfer roller 57*b* at the downstream location. In this process, the current measurement unit 581*a* measures the currents I1*a* and I2*a* that flow when the adjustment voltages V1 and V2 are applied to the secondary transfer roller 57*a*, while the current measurement unit 581*b* measures the currents I1*b* and I2*b* that flow when the adjustment voltages V1 and V2 are applied to the secondary outer transfer roller 57*b*. The measurement by the current measurement unit 581*b* as to the currents flowing through the secondary outer transfer roller 57*b* at the downstream location is performed while the voltage V1 or V2 is applied to the secondary outer transfer roller 57*a* at the upperstream location. Thus, the adjustment of the secondary outer transfer roller 57*b* at the downstream location is performed in a state similar to an actual image forming state. Based on the correlation between the voltage (V1, V2) and the current (I1*a*, I2*a*), a calculation is performed to determine a voltage Via needed to achieve a target current Ita at the upstream location needed in the secondary transfer at the location of the upstream secondary outer transfer roller 57*a*. The setting of the target current Ita will be described in detail later. Based on the calculated voltage V1*a*, a target voltage Vta of the secondary transfer voltage applied to the upstream secondary outer transfer roller 57*a* is set Similarly, based on the correlation between the voltage (V1, V2) and the current (I1*b*, I2*b*), a calculation is performed to determine a voltage V1*b* needed to achieve a target current Itb needed in the secondary transfer at the location of the downstream secondary outer transfer roller 57*b*. The setting of the target current Itb will be described in detail later. Based on the calculated voltage V1*b*, a target voltage Vtb of the secondary transfer voltage applied to the downstream secondary outer transfer roller 57*b* is set.

Figure 2:
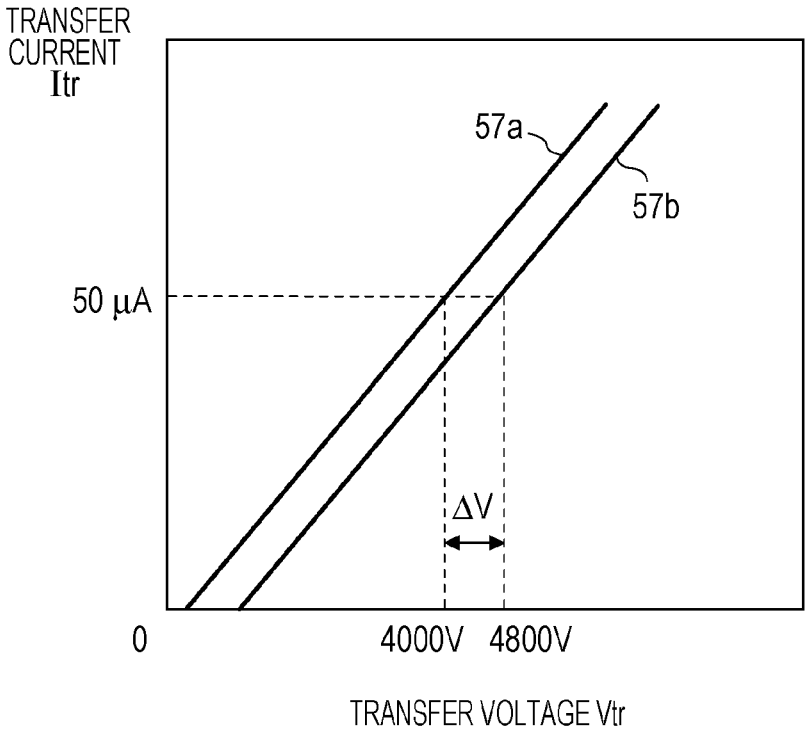
FIG. 2 is a graph illustrating a relationship between a transfer current and a transfer voltage in an image forming apparatus according to an embodiment of the present invention.

FIG. 2 illustrates the relationship between the transfer voltage and the transfer current in the secondary transfer portion of the image forming apparatus according to the present embodiment. The toner and the recording material P are charged during the transfer process at the upstream secondary outer transfer roller 57*a*, and the presence of electric charges thereon makes it difficult to transfer the image at the location of the downstream secondary outer transfer roller 57*b*. Therefore, the voltage needed to obtain the same particular value of current is higher by ΔV at the downstream secondary outer transfer roller 57*b* than needed at the upstream secondary outer transfer roller 57*a*. In the present embodiment, the difference in voltage, ΔV, is, for example, about 800 V. For example, the applied voltage needed to achieve a current of 50 μA is 4000 V at the upstream secondary outer transfer roller 57*a* and 4800 V at the downstream secondary outer transfer roller 57*b*.

In the present embodiment, to set the target voltages Vta and Vtb of the secondary transfer voltages applied to the upperstream and downstream secondary outer transfer rollers 57*a* and 57*b*, the adjustment voltages are applied by the secondary transfer voltage power supplies 58*a* and 58*b* to the respective secondary outer transfer rollers 57*a* and 57*b* at the upperstream and downstream locations. However, the manner of applying the adjustment voltages is not limited to that described above. For example, setting the target voltages Vta and Vtb of the secondary transfer voltages may be performed as follows. That is, an adjustment voltage is applied to one of the secondary outer transfer rollers 57*a* and 57*b*, and an adjustment voltage for the other one of the secondary outer transfer rollers may be determined according to the correlation shown in FIG. 2. More specifically, first, to set the target voltage Vta of the upstream secondary outer transfer roller 57*a*, an adjustment voltage is applied to the upstream secondary outer transfer roller 57*a* and a current is measured. The correlation between the voltage and the current is calculated based on a result of the measurement, and the target voltage Vta is set based on the calculated correlation. On the other hand, the setting of the target voltage Vtb of the downstream secondary outer transfer roller 57*b* is performed based on the voltage-current correlation calculated based on the result of the measurement for the upstream secondary outer transfer roller 57*a*. More specifically, the voltage-current correlation calculated based on the result of the measurement of the upstream secondary outer transfer roller 57*a* is shifted by a properly value in a higher voltage direction, and the target voltage Vtb for the downstream location is set based on the shifted relation. Thus, the target voltage Vtb can be set without performing the process of applying the voltage to the downstream secondary outer transfer roller 57*b*.

Setting Relative Values of Target Currents

In an embodiment described below, a transfer current for transferring a toner image is divided into two flows, i.e., one flowing through an upstream current path and the other flowing through a downstream current path. The upstream current path passes through the upstream secondary outer transfer roller 57*a*, the first pressing unit, and the upstream secondary inner transfer roller 57*a*, and the downstream current path passes through the downstream secondary outer transfer roller 57*b*, the second pressing unit, and the downstream secondary inner transfer roller 57*b*. The sum of target currents necessary to transfer a whole toner image to a recording material is set in advance depending on the structure of the image forming apparatus and parameters such as a conveying speed. When the sum of target currents is given, the ratio of the upstream target current Ita at the upstream secondary outer transfer roller 57*a* to the sum of the target currents, and the ratio of the downstream target current Itb at the downstream secondary outer transfer roller 57*b* to the sum of the target currents are determined.

In the present embodiment, the relative values of the downstream target current Itb and the upstream target current Ita are changed by the control unit 200 depending on the thickness of the recording material P. More specifically, in the present embodiment, the sum of target currents is divided at a particular ratio into the upstream current path and the downstream current path according to Table 1 shown below. The control unit 200 has a function (first function) of setting the downstream target current Itb to be lower than the upstream target current Ita and a function (second function) of setting the downstream target current Itb to be higher than the upstream target current Ita. The control unit 200 has a function (first function) of setting the downstream target current Itb to be lower than the upstream target current Ita and a function (second function) of setting the downstream target current Itb to be higher than the upstream target current Ita.

TABLE 1

| | Basis weight of recording material (g/m$^2$) | | |
|---|---|---|---|
| | ≤70 | 70 to 150 | ≥150 |
| Relative value of target current Ita for upstream secondary transfer roller 57a (%) | 70 | 50 | 30 |
| Relative value of target current Itb for downstream secondary transfer roller 57b (%) | 30 | 50 | 70 |

The control unit 200 has a function (first function) of setting the downstream target current Itb to be lower than the upstream target current Ita and a function (second function) of setting the downstream target current Itb to be higher than the upstream target current Ita. Table 1 is a control table that is stored in advance in a storage unit in the control unit 200. According to this control table, the relative value of the upstream target current Ita at the upstream secondary outer transfer roller 57*a* and the relative value of the downstream target current Itb at the downstream secondary outer transfer roller 57*b* are changed depending on the basis weight of the recording material as follows. When the basis weight is equal to or larger than 150 g/m$^2$, the relative value of the upstream target current Ita is set to 30% and the relative value of the downstream target current Itb is set to 70%. When the basis weight is larger than 70 g/m$^2$ and smaller than 150 g/m$^2$, the relative value of the upstream target current Ita is set to 50% and the relative value of the downstream target current Itb is set to 50%. When the basis weight is equal to or smaller than 70 g/m$^2$, the relative value of the upstream target current Ita is set to 70% and the relative value of the downstream target current Itb is set to 30%.

That is, when the basis weight of the recording material is small (i.e., when the recording material has a first thickness), the ratio of the downstream target current Itb to the upstream target current Ita is set to be low (to a first ratio). When the basis weight of the recording material is large (i.e., when the recording material has a second thickness larger than the first thickness), the ratio of the downstream target current Itb to the upstream target current Ita is set to be high (to a second ratio higher than the first ratio). Thus, in a first image forming mode employed when the basis weight of the recording material is small, the ratio of the transfer current flowing through the downstream secondary outer transfer roller is set to be low. On the other hand, in a second image forming mode employed when the basis weight of the recording material is large, the ratio of the transfer current flowing through the upstream secondary outer transfer roller is set to be low. That is, in the present embodiment, the image forming process is performed in an image forming mode selected by the control unit 200 from a plurality of image forming modes.

Figure 4:
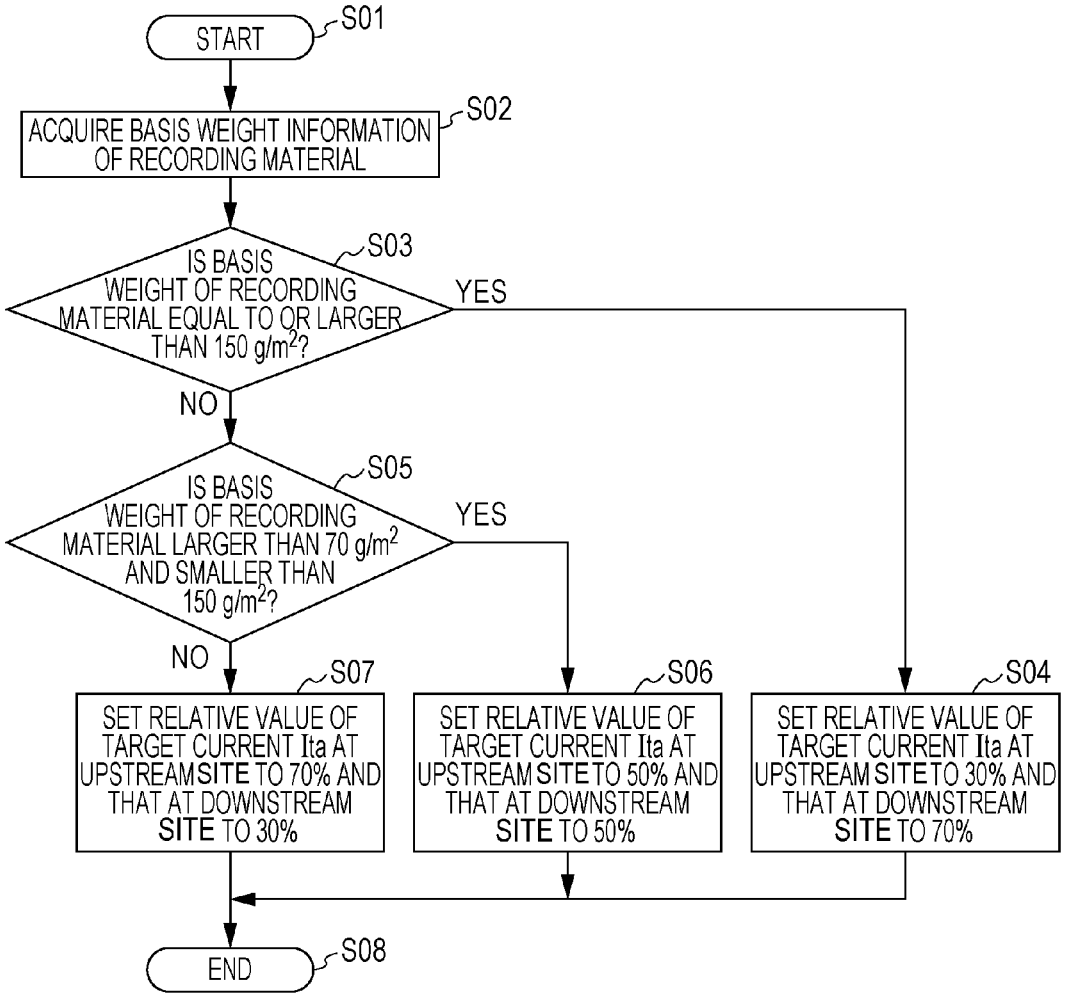
FIG. 4 is a flow chart illustrating a process according to a first embodiment.

Referring to a flow chart shown in FIG. 4, a process of determining the relative value of the upstream target current Ita and the relative value of the downstream target current Itb is described below. If the process is started (step S01), basis weight information set by a user associated with a recording material is read (step S02), and a determination is made as to whether the basis weight is equal to or larger than 150 g/m$^2$ (step S03). In a case where the recording material has a basis weight equal to or larger than 150 g/m$^2$, it is necessary to reduce the upstream transfer current at the upstream secondary outer transfer roller 57*a*. In a case where the basis weight of the recording material is equal to or larger than 150 g/m$^2$, then the control unit 200 sets the relative values such that the relative value of the upstream target current Ita is set to 30% and the relative value of the downstream target current Itb is set to 70% (step S04), and the process is ended (step S08). As a result of the setting described above, the voltage applied to the upstream secondary outer transfer roller 57*a* is controlled to be not large, and an occurrence of upstream electric discharge at the upstream secondary outer transfer roller 57*a* is suppressed. This suppresses an occurrence of splattering of toner that can cause degradation in image quality. On the other hand, in a case where the determination in step S03 is negative as to whether the basis weight of the recording material is equal to or larger than 150 g/m$^2$, a further determination is made as to whether the basis weight of the recording material is larger than 70 g/m$^2$ and smaller than 150 g/m$^2$ (step S05). If the basis weight of the recording material is larger than 70 g/m$^2$ and smaller than 150 g/m$^2$, the relative value of the upstream target current Ita is set to 50% and the relative value of the downstream target current Itb is set to 50% (step S06), and the process is ended (step S08). In a case where the determination in step S05 is negative as to whether the basis weight of the recording material is larger than 70 g/m$^2$ and smaller than 150 g/m$^2$, it is concluded that the basis weight of the recording material is equal to smaller than 70 g/m$^2$. In this case, the transfer current at the downstream side is reduced to ensure that the recording material having a small thickness and being low in rigidity can be separated from the transfer belt 91. Thus, in the case where the basis weight of the recording material is equal to smaller than 70 g/m$^2$, the control unit 200 sets the relative values of the target currents such that the relative value of the upstream target current Ita is set to 70% and the relative value of the downstream target current Itb is set to 30% (step S07), and the process is ended (step S08). As a result of this setting, the voltage applied to the downstream secondary outer transfer roller 57*b* is controlled to be not large, which results in a reduction in downstream electric field formed at secondary outer transfer roller 57*b*. Thus, it is possible to reduce the probability that the recording material remains on the intermediate transfer belt 51 without being separated thereform after the secondary transfer process is complete.

When the recording material P is thick paper (for example, paper with a basis weight larger than 150 g/m$^2$), and in particular when the recording material P is curled at its leading or trailing end, a curled part thereof tends not to be brought in close contact with the intermediate transfer belt 51 and thus a gap is produced between the recording material P and the intermediate transfer belt 51. In this case, when the recording material P having the part being apart from the intermediate transfer belt 51 enters a region close to the secondary transfer portion, the recording material P receives an influence of the transfer electric field. This makes the toner transfer position unstable in a region upstream of the secondary transfer portion, which may cause the toner to be spattered, which may result in degradation in image quality. Besides, an electric discharge may occur in the gap between the recording material P and the intermediate transfer belt 51, which may cause the image to have transfer-failed portions.

In the present embodiment, to prevent a transfer failure due to toner splatting or electric discharge, the relative value of the transfer current flowing through the upstream secondary outer transfer roller 57*a* is reduced when the thickness of the recording material is equal to or larger than a particular value (more specifically, when the basis weight is equal to or larger than 150 g/m$^2$). That is, by reducing the applied voltage and the transfer current flowing through the upstream transfer member, toner splattering or electric discharge which may cause degradation in image quality is prevented from occurring.

On the other hand, when the thickness of the recording material P is small (more specifically, when the basis weight is equal to or smaller than 70 g/m$^2$), the image forming process and associated parameters are controlled as follows. In this case, in a region downstream of the secondary transfer portion, when the recording material P stuck to the transfer belt 91 is attracted by the transfer bias toward the intermediate transfer belt 51, the recording material P may be wound around the intermediate transfer belt 51. As a result, a separation failure may occur in the secondary transfer portion. Note that in the opposite case in which the recording material P is paper having a large thickness and being rigid, the rigidity prevents the recording material P from being wound around the intermediate transfer belt 51 by the attraction by the transfer bias toward the intermediate transfer belt 51, and thus a separation failure is suppressed. In the present embodiment, in view of the above, when the thickness of the recording material is smaller than a particular value (more specifically, when the basis weight is smaller than 70 g/m$^2$), the relative value of the transfer current flowing through the downstream secondary outer transfer roller 57*b* is reduced. This results in a reduction in force by the transfer bias that attracts the recording material toward the intermediate transfer belt 51, and thus the occurrence of a separation failure is suppressed even for thin recording materials.

In the present embodiment, the relative values transfer currents are controlled based on the basis weight information given by a user as described above. Alternatively, a sensor may be disposed in the image forming apparatus and the basis weight of the recording material may be determined based on information output from the sensor. In this case where the control unit 200 controls the relative transfer currents according to the basis weight determined based on the information output from the sensor, the reduction in the secondary transfer current can be correctly controlled even in a case where the stack of recording materials placed in a cassette include a mixture of recording materials with high basis weight and recording materials with low basis weight. That is, even in the case where recording materials with low basis weight are placed by mistake together with recording materials with high basis weight in the cassette, it is possible to deal with the recording materials with low basis weight without encountering the separation failure.

As for the sensor, a weight sensor may be disposed in the middle of the recording material conveying path to detect the weight of the recording material being conveyed. The basis weight of the recording material may be determined based on the weight detected by the weight sensor and size information indicating the size (area) of the recording material. Alternatively, a transmission-type optical sensor capable of detecting optical transmittance of the recording material may be disposed in the middle of the recording material conveying path, and the basis weight of the recording material may be determined based on the optical transmittance of the recording material being conveyed.

In the present embodiment, the control unit 200 also has a function of changing the relative values of the upstream target current Ita and the downstream target current Itb depending of the moisture content of the recording material. To determine the moisture content, an absolute moisture content sensor is provided as a measuring unit to measure the absolute moisture content. That is, this sensor functions an acquisition unit for acquiring information associated with the moisture content. In the present embodiment, the moisture content of the recording material is indicated by the absolute moisture content (g/kg) as described above. However, alternatively, temperature and humidity (i.e., relative moisture content) may be used.

In the present embodiment, the sum of target currents is divided at a particular ratio into the upstream current path and the downstream current path according to Table 2. Table 2 is a control table that is stored in advance in a storage unit disposed in the control unit 200. This control table illustrates relative values of the upstream target current Ita applied to the upstream secondary outer transfer roller 57*a* and relative values of the downstream target current Itb applied to the downstream secondary outer transfer roller 57*b* for various values of absolute moisture content of a given recording material. As shown in Table 2, when absolute moisture content is smaller than 5 g/kg, the relative value of the upstream target current Ita is set to 30% and the relative value of the downstream target current Itb is set to 70%.

TABLE 2

| | Absolute moisture content (g/kg) | | | |
|---|---|---|---|---|
| | <5 | ≥5 < 10 | ≥10 < 15 | ≥15 |
| Relative value of target current Ita for upstream secondary transfer roller 57a (%) | 30 | 45 | 55 | 70 |
| Relative value of target current Itb for downstream secondary transfer roller 57b (%) | 70 | 55 | 45 | 30 |

When absolute moisture content is equal to or larger than 5 g/kg and smaller than 10 g/kg, the relative value of the upstream target current Ita is set to 45% and the relative value of the downstream target current Itb is set to 55%. When absolute moisture content is equal to or larger than 10 g/kg and smaller than 15 g/kg, the relative value of the upstream target current Ita is set to 55% and the relative value of the downstream target current Itb is set to 45%. When absolute moisture content is equal to or larger than 15 g/kg, the relative value of the upstream target current Ita is set to 70% and the relative value of the downstream target current Itb is set to 30%.

That is, when the absolute moisture content is large (first moisture content), the ratio of the downstream target current Itb to the upstream target current Ita is reduced. Conversely, when the absolute moisture content is small (second moisture content smaller than first moisture content), the ratio of the downstream target current Itb to the upstream target current Ita is increased.

Thus, in a first image forming mode employed when the absolute moisture content of the recording material is large, the relative value of the transfer current flowing through the downstream secondary outer transfer roller 57*b* is low. On the other hand, in a second image forming mode employed when the absolute moisture content of the recording material is small, the relative value of the transfer current flowing through the upstream secondary outer transfer roller 57*a* is low.

Figure 5:
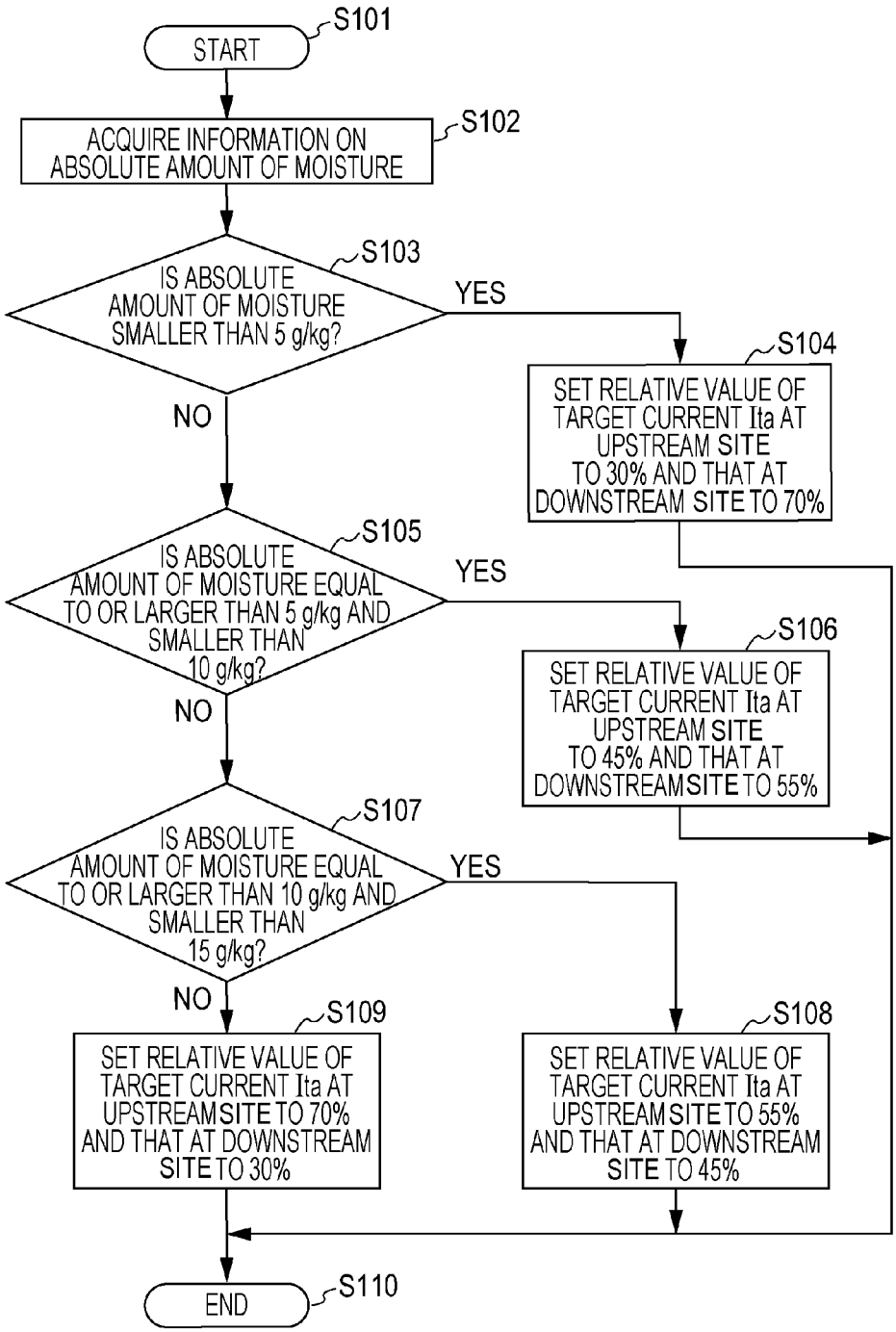
FIG. 5 is a flow chart illustrating a process according to a first embodiment.

Referring to a flow chart shown in FIG. 5, a process of determining the relative value of the upstream target current Ita and the relative value of the downstream target current Itb is described below. If the process is started (step S101), the absolute moisture content measured by the absolute moisture content sensor is read (step S102), and a determination is made as to whether the absolute moisture content is smaller than 5 g/kg (step S103). When the absolute moisture content is smaller than 5 g/kg, it is necessary to reduce the upstream transfer current at the upstream secondary outer transfer roller 57*a*. Therefore, when the measured absolute moisture content is smaller than 5 g/kg, the control unit 200 sets the relative values such that the relative value of the upstream target current Ita is set to 30% and the relative value of the downstream target current Itb is set to 70% (step S104), and the process is ended (step S110). As a result of this setting, the voltage applied to the upstream secondary outer transfer roller 57*a* is controlled not to be large, and the occurrence of electric discharge in the region upstream of the secondary outer transfer roller 57*a* is suppressed. This suppresses an occurrence of splattering of toner that can cause degradation in image quality. In a case where it is determined in step S103 that the absolute moisture content is not smaller than 5 g/kg, then a further determination is made as to whether the absolute moisture content is equal to or larger than 5 g/kg and smaller than 10 g/kg (step S105). When the absolute moisture content is equal to or larger than 5 g/kg and smaller than 10 g/kg, the relative value of the upstream target current Ita is set to 45% and the relative value of the downstream target current Itb is set to 55% (step S106), and the process is ended (step S110). In a case where the answer to step S105 is negative as to whether the absolute moisture content is equal to or larger than 5 g/kg and smaller than 10 g/kg, a further determination is made as to whether the absolute moisture content is equal to or larger than 10 g/kg and smaller than 15 g/kg (step S107). When the absolute moisture content is equal to or larger than 10 g/kg and smaller than 15 g/kg, the relative value of the upstream target current Ita is set to 55% and the relative value of the downstream target current Itb is set to 45% (step S108), and the process is ended (step S110). In a case where the answer to step S107 is negative as to whether the absolute moisture content is equal to or larger than 10 g/kg and smaller than 15 g/kg, the relative value of the upstream target current Ita is set to 70% the relative value of the downstream target current Itb is set to 30% (step S109), and the process is ended (step S110). As a result of this setting, the voltage applied to the downstream secondary outer transfer roller 57*b* is controlled not to be large, which results in a reduction in electric field formed in a downstream region close to the downstream secondary outer transfer roller 57*b*, and thus it becomes possible to prevent even the recording material having a large absolute moisture content and thus having a low rigidity from remaining on the intermediate transfer belt 51 without being separated therefrom after the secondary transfer process.

In a case where the recording material being conveyed has a small absolute moisture content, the toner is more electrically charged, which tends to cause an increase in transfer current. However, if the applied voltage is increased to increase the transfer current, then this can cause an increase in probability that toner is splattered before the recording material P comes into contact with the intermediate transfer belt 51 in the region upstream of the secondary transfer portion. In the present embodiment, to prevent a transfer failure due to toner splattering or electric discharge, the relative value of the transfer current flowing through the upstream secondary outer transfer roller 57*a* is reduced when the absolute moisture content is low. By reducing the applied voltage and the transfer current flowing through the upstream transfer member, it is possible to prevent toner splattering and electric discharge that may cause degradation in image quality.

On the other hand, in a case where the recording material P being conveyed has a large absolute moisture content, the moisture absorbed in the recording material P may cause an increase in curling, and may cause a reduction in rigidity of the recording material P. In this case, in a region downstream of the secondary transfer portion, when the recording material P stuck to the transfer belt 91 is attracted by the transfer bias toward the intermediate transfer belt 51, the recording material P may be wound around the intermediate transfer belt 51. As a result, a separation failure may occur in the secondary transfer portion. In the present embodiment, to avoid the above problem, the relative value of the transfer current flowing through the downstream secondary outer transfer roller 57*b* is reduced when the absolute moisture content is high thereby reducing the force of the transfer bias that attracts the recording material P to the intermediate transfer belt 51 whereby it becomes possible to reduce the separation failure even in the case where thin paper is used as the recording material P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-101427 filed Apr. 28, 2011, which is hereby incorporated by reference herein in its entirety.

What is claimed is:

1. An image forming apparatus comprising:

an image bearing unit configured to bear toner images;

an intermediate transfer belt configured to be movable and to bear the toner images transferred from the image bearing unit;

a first inner roller disposed in contact with an inner surface of the intermediate transfer belt, and located downstream of the image bearing unit in a moving direction of the intermediate transfer belt;

a second inner roller disposed in contact with the inner surface of the intermediate transfer belt, and located adjacent to and downstream of the first inner roller in the moving direction;

a first opposing roller disposed opposite the first inner roller across the intermediate transfer belt to form a first nip therebetween;

a second opposing roller disposed opposite the second inner roller across the intermediate transfer belt to form a second nip therebetween;

a first voltage source configured to apply a voltage between the first inner roller and the first opposing roller to transfer the toner images from the intermediate transfer belt to a recording material;

a second voltage source configured to apply a voltage between the second inner roller and the second opposing roller to transfer the toner images from the intermediate transfer belt to the recording material;

an acquisition unit configured to acquire information associated with a moisture content in air; and a setting portion configured to set a voltage of the first voltage source and a voltage of the second voltage source during an image formation period so that, in a case where the information acquired by the acquisition unit indicates a first moisture content, a ratio of a current of the second voltage source to a current of the first voltage source is smaller than the ratio of the current in a case where the information indicates a second moisture content being less than the first moisture content.

2. The image forming apparatus according to claim 1, further comprising a conveying belt configured to convey the recording material, wherein the first opposing roller and the second opposing roller are disposed in contact with an inner surface of the conveying belt.

3. The image forming apparatus according to claim 1, further comprising an execution portion configured to execute a test mode to obtain a relationship between a voltage and a current for each of the first voltage source and the second voltage source during a period other than the image formation period, wherein the setting portion sets the voltage of the first voltage source and the voltage of the second voltage source based on the relationships obtained in the test mode.

4. The image forming apparatus according to claim 3, wherein the execution portion obtains a relationship between a voltage of the second voltage source and a current thereof based on a relationship between a voltage of the first voltage source and a current thereof.

5. The image forming apparatus according to claim 1, wherein the first inner roller and the second inner roller are grounded, and wherein the first voltage source is connected to the first opposing roller, and the second voltage source is connected to the second opposing roller.

6. An image forming apparatus comprising:

an image bearing unit configured to bear toner images;

an intermediate transfer belt configured to be movable and to bear the toner images transferred from the image bearing unit;

a first inner roller disposed in contact with an inner surface of the intermediate transfer belt;

a second inner roller disposed in contact with the inner surface of the intermediate transfer belt, and located adjacent to and downstream of the first inner roller in a moving direction of the intermediate transfer belt;

a first opposing roller disposed opposite the first inner roller across the intermediate transfer belt to form a first nip therebetween;

a second opposing roller disposed opposite the second inner roller across the intermediate transfer belt to form a second nip therebetween;

a first voltage source configured to apply a voltage between the first inner roller and the first opposing roller to transfer the toner images from the intermediate transfer belt to a recording material;

a second voltage source configured to apply a voltage between the second inner roller and the second opposing roller to transfer the toner images from the intermediate transfer belt to the recording material;

an acquisition unit configured to acquire information associated with a basis weight of the recording material; and a setting portion configured to set a voltage of the first voltage source and a voltage of the second voltage source during an image formation period so that, in a case where the information acquired by the acquisition unit indicates a first basis weight, a ratio of a current of the second voltage source to a current of the first voltage source is smaller than the ratio of the current in a case where the information indicates a second basis weight being less than the first basis weight.

7. The image forming apparatus according to claim 6, further comprising a conveying belt configured to convey the recording material, wherein the first opposing roller and the second opposing roller are disposed in contact with an inner surface of the conveying belt.

8. The image forming apparatus according to claim 6, further comprising an execution portion configured to execute a test mode to obtain a relationship between a voltage and a current for each of the first voltage source and the second voltage source during a period other than the image formation period, wherein the setting portion sets the voltage of the first voltage source and the voltage of the second voltage source based on the relationships obtained in the test mode.

9. The image forming apparatus according to claim 8, wherein the execution portion obtains a relationship between a voltage of the second voltage source and a current thereof based on a relationship between a voltage of the first voltage source and a current thereof.

10. The image forming apparatus according to claim 6, wherein the first inner roller and the second inner roller are grounded, and wherein the first voltage source is connected to the first opposing roller, and the second voltage source is connected to the second opposing roller.

* * * * *